United States Patent [19]

Martineau

[11] Patent Number: 4,464,313

[45] Date of Patent: Aug. 7, 1984

[54] CARBURETTOR

[75] Inventor: Yves Martineau, Pontchartrain, France

[73] Assignee: Societes Anonymes: Automobiles Citroen et Automobiles Peugeot, Paris, France

[21] Appl. No.: 553,876

[22] Filed: Nov. 21, 1983

Related U.S. Application Data

[63] Continuation of Ser. No. 327,236, Dec. 3, 1981, abandoned.

[30] Foreign Application Priority Data

Dec. 15, 1980 [FR] France ..... 80 26853

[51] Int. Cl.[3] ..... F02M 7/02

[52] U.S. Cl. ..... 261/78 R; 261/DIG. 39

[58] Field of Search ..... 261/78 R, DIG. 39

[56] References Cited

U.S. PATENT DOCUMENTS

| | | | |
|---|---|---|---|
| 1,418,756 | 6/1922 | Waldon | 261/76 |
| 2,152,057 | 3/1939 | Killmeyer et al. | 261/DIG. 39 |
| 2,328,764 | 9/1943 | Wirth | 261/DIG. 39 |
| 2,996,290 | 8/1961 | Munden | 261/DIG. 39 |
| 3,648,988 | 3/1972 | Dibert | 261/DIG. 39 |
| 4,146,596 | 3/1979 | Saito et al. | 261/DIG. 39 |
| 4,186,158 | 1/1980 | Yamada | 216/DIG. 39 |

FOREIGN PATENT DOCUMENTS

| | | | |
|---|---|---|---|
| 595128 | 4/1934 | Fed. Rep. of Germany | 261/DIG. 39 |
| 2330709 | 1/1975 | Fed. Rep. of Germany | 261/78 R |
| 419687 | 4/1947 | Italy | 261/78 R |
| 454350 | 1/1950 | Italy | 261/78 R |
| 52-4925 | 1/1977 | Japan | 261/78 R |
| 53-14236 | 2/1978 | Japan | 261/DIG. 39 |

OTHER PUBLICATIONS

Webster's Seventh New Collegiate Dictionary, Apr. 1965, p. 952.

*Primary Examiner*—Tim R. Miles

*Attorney, Agent, or Firm*—Karl F. Ross; Herbert Dubno

[57] ABSTRACT

The carburettor comprises a center emulsion tube dividing the passageway for combustion air into an inner circuit and an outer circuit, an air-gasoline emulsion intake passageway opening laterally into the inner circuit. The inner air circuit essentially comprises a cylindrical, thin-walled portion on the upstream side and a truncated, thin-walled portion on the downstream side.

3 Claims, 4 Drawing Figures

CARBURETTOR

This application is a continuation of application Ser. No. 327,236 filed Dec. 3, 1981, now abandoned.

FIELD OF THE INVENTION

The present invention relates to a carburettor.

BACKGROUND OF THE INVENTION

Carburettors comprise a passageway for the passage of combustion air provided with a portion in the form of a Venturi at the throat of which a passage for the admission of an air-gasoline emulsion opens. In certain carburettors, a centre emulsion tube is provided, which divides the combustion air passage into an inner circuit and an outer circuit, and which is placed so that its downstream end is located at the throat of the air passageway. The quantity of gasoline admitted into the air passageway depends on the depression which is produced by the inner circuit at the level of the air-gasoline emulsion intake passageway.

The centre emulsion tubes are most often constituted at the present time by a simple cylindrical tube in which the emulsion intake passageway opens laterally.

Center emulsion tubes are also known, of which the inner circuit has the form of a venturi, the emulsion intake passageway opening substantially at the throat of the Venturi. The flow of the air in the inner circuit produces at the Venturi throat of the centre emulsion tube a greater depression, which enables more gasoline to be sucked in. This type of center emulsion tube is more stable than the preceding one. By regulating the main jet upstream in order to adjust the rate of flow so that it has the correct value at normal speed, the center emulsion tube allows a more regular functioning at low r.p.m.

OBJECT OF THE INVENTION

It is an object of the present invention to provide a carburettor with a centre emulsion tube, whose functioning is improved with respect to the known types devices.

SUMMARY OF THE INVENTION

The carburettor of the invention is characterized in that the inner air circuit essentially comprises a cylindrical, thin-walled portion on the upstream side, and a truncated, thin-walled portion on the downstream side.

The cylindrical and truncated portions advantageously have substantially the same height.

The inclination of the inner face of the truncated portion is preferably the same as that of the divergent part forming the choke of the air passageway of the carburettor.

BRIEF DESCRIPTION OF THE DRAWING

The invention will be more readily understood on reading the following description with reference to the accompanying drawing, in which.

SPECIFIC DESCRIPTION

Figure 1:
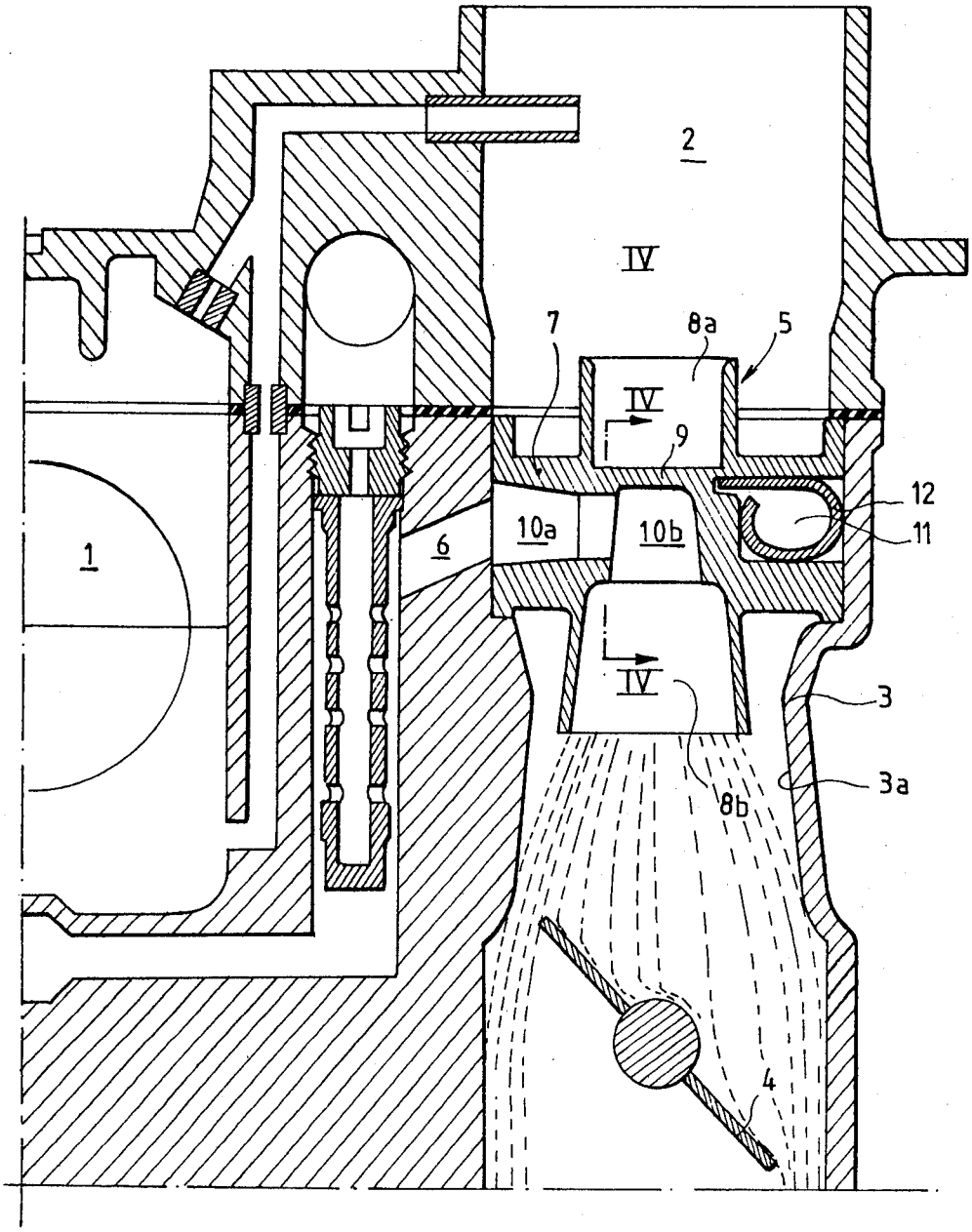
FIG. 1 is a partial view in section through the carburettor, the center emulsion tube being cut along the line I—I of FIG. 2.
Figure 2:
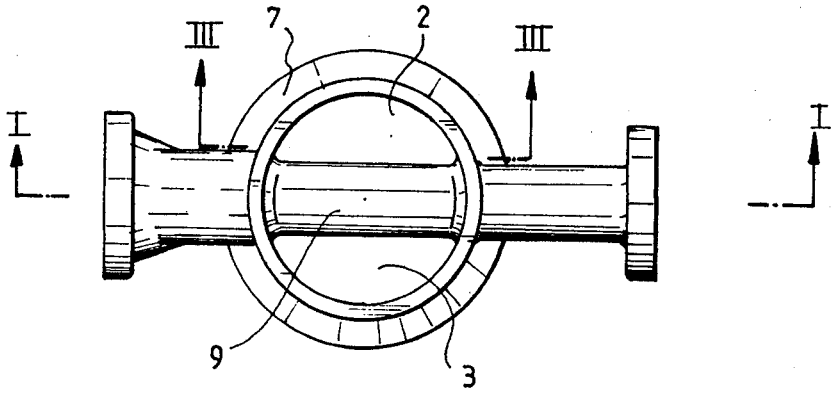
FIG. 2 is a plan view of the center emulsion tube.
Figure 3:
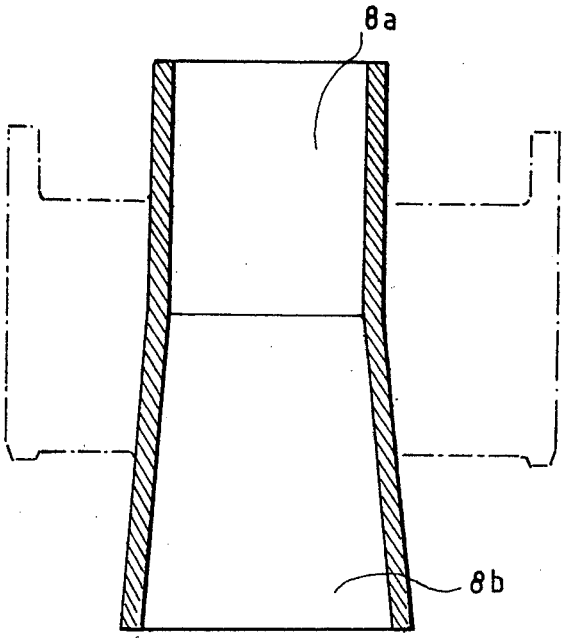
FIG. 3 is a view in section of the centre emulsion tube along III—III of FIG. 2.

Referring now to the drawings, FIG. 1 shows a carburettor comprising, in conventional manner, a storage chamber 1 for gasoline and an air passageway 2 which has a throat 3 followed by a diffuser 3*a* and a throttle valve 4 disposed downstream of the diffuser. A center emulsion tube 5 is disposed in the passageway 2, upstream of the throat 3, and enables to admit at this throat an air-gasoline emulsion which arrives through a passageway 6.

The center emulsion tube 5 comprises a body 7, preferably made of a light alloy, which is traversed by a thin-walled tube with parallel faces, of vertical axis and of circular section. The upper part 8*a* of this tube is externally and internally cylindrical. Its lower part 8*b* is internally and externally truncated; its conicity is the same as that of the diffuser 3*a* of the carburettor. The two parts 8*a* and 8*b* are substantially of the same height.

Figure 4:
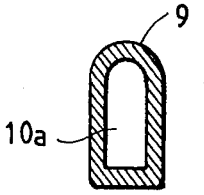
FIG. 4 is a view thereof in section along IV—IV of FIG. 3.

In its median part, the body 7 has a horizontal element 9 passing therethrough. This element 9 projects laterally on either side of the body 7 and its oiuter section has the form of a rectangle of which the upper edge is rounded (cf. FIG. 4). It is pierced with a passageway at right angles which comprises an inlet portion 10*a* opening opposite the passageway 6, and an outlet portion 10*b* wich opens substantially at the center of the vertical tube 8*a*–8*b* and is directed downwardly. The inlet portion 10*a* has a rectangular transverse section with a rounded upper edge, like element 9. This section decreases from the inlet of the passageway to its connection with the outlet portion 10*b*. This outlet portion is truncated and thus forms a diffuser; its conicity is the same as that of the inner face of the lower portion 8*b* of the center emulsion tube.

The horizontal element 9 further comprises, on the side opposite the inlet portion 10*a* a blind recess 11 in which is housed a spring 12 retaining the center emulsion tube against the wall of the carburettor opposite that at which the passageway 6 opens.

This center emulsion tube is disposed in the air passageway 2 of the carburettor so that the base of the body 7 is located at the level of the throat 3 of this passageway.

In operation, the center emulsion tube divides the air current passing through the passageway 2 into an outer flow which passes around the center emulsion tube and into an inner flow which passes through tube 8*a*–8*b*. The inner flow produces a depression in the passageway 10*b* so that air-gasoline emulsion is sucked in from the passageway 6 and enters passageway 2.

The center emulsion tube which has just been described promotes the rate of flow of the air circuit inside the centre emulsion tube with respect to the rate of flow of the air circuit outside. For a small opening of the throttle valve, the air which passes inside the center emulsion tube and which contains the sucked in gasoline, passes around the throttle valve, on two opposite sides thereof and mixes with the air of the outer circuit, as shown in FIG. 1. In conventional center emulsion tubes, in which the part 8*b* is externally cylindrical, the air-containing gasoline is maintained by the air of the outer circuit in the central portion of the passageway 2. It passes through the throttle valve asymmetrically, preponderantly towards the lower downstream edge of this throttle valve.

Furthermore, although the rate of flow of the inner air circuit is promoted by the center emulsion tube according to the invention, a weaker depression at the throat 3 corresponds thereto, so that the mixture resulting downstream of the throttle valve 4 is both cleaner and more homogeneous.

The main jet of the carburettor being regulated for optimum functioning at normal speed, the mixture is optimized for a larger range of speeds than with the conventional center emulsion tubes; in addition, transitory functioning does not present any instability.

It is obvious that the present invention is not to be considered as being limited to the embodiment which has been described and shown, but covers, on the contrary, all the variants thereof.

I claim:

1. In a carburettor having a combustion-air passageway extending from an intake to a discharge side thereof, an air-gasoline emulsion passageway opening laterally into said combustion-air passageway, and a throttle valve in said combustion-air passageway downstream of said emulsion passageway, the improvement which consists of a one-piece center emulsion tube comprising:

an internally and externally axially extending cylindrical upstream tubular portion disposed with all-around clearance in said combustion-air passageway for partitioning air flow therethrough into an outer flow and an inner flow, a radial tubular portion extending across said inner flow downstream of said cylindrical tubular portion and communicating with said emulsion passageway and opening axially in a downstream direction centrally within said inner flow, and an internally and externally axially extending frustoconical portion of constant wall thickness downstream of said radial portion and diverging in said downstream direction for discharging a mixture of said inner flow and an air-gasoline emulsion divergently over substantially the full cross section of said combustion-air passageway in the region thereof provided with said throttle valve, said combustion-air passageway being provided between said emulsion passageway and said throttle valve with a frustoconically diverging diffuser and said frustoconical portion diverging with an angle substantially the same as the divergence of said diffuser.

2. The improvement defined in claim 1 wherein said cylindrical upstream tubular portion and said frustoconical portion have substantially the same axial lengths.

3. The improvement defined in claim 1 wherein said portions are formed in one piece and said radial tubular portion includes a further portion provided with a blind bore opening toward a wall of said combustion-air passageway opposite that of the wall provided with said emulsion passageway, said blind bore being provided with a spring engaging said wall of said combustion-air passageway opposite said emulsion passageway.

* * * * *